US006866103B2

(12) United States Patent
Ballu

(10) Patent No.: US 6,866,103 B2
(45) Date of Patent: Mar. 15, 2005

(54) STATIONARY AUTOMATIC FIRE-EXTINGUISHING INSTALLATION

(75) Inventor: Patrick Ballu, Epernay (FR)

(73) Assignee: Exel Industries, Epernay (FR)

( * ) Notice: Subject to any disclaimer, the term of this patent is extended or adjusted under 35 U.S.C. 154(b) by 74 days.

(21) Appl. No.: 10/332,818

(22) PCT Filed: Jul. 12, 2001

(86) PCT No.: PCT/FR01/02284

§ 371 (c)(1),
(2), (4) Date: Jun. 23, 2003

(87) PCT Pub. No.: WO02/04077

PCT Pub. Date: Jan. 17, 2002

(65) Prior Publication Data

US 2004/0089457 A1 May 13, 2004

(30) Foreign Application Priority Data

Jul. 12, 2000 (FR) ..... 00 09080

(51) Int. Cl.[7] ..... A62C 39/00

(52) U.S. Cl. ..... 169/91; 169/5; 169/9; 169/11; 169/37; 169/54; 169/60; 169/85; 239/222.11; 239/373; 239/208

(58) Field of Search ..... 169/5, 9, 10, 11, 169/37, 54, 56, 60, 70, 85, 91; 239/14.1, 77, 208, 209, 222.11, 222.17, 346, 373, 419, 433

(56) References Cited

U.S. PATENT DOCUMENTS 2,891,624 A * 6/1959 McBride ..... 169/91
3,548,949 A * 12/1970 Barrow et al. ..... 169/91
4,427,074 A * 1/1984 Wollin ..... 239/222.11
4,907,654 A * 3/1990 Eberhardt ..... 169/70
4,976,319 A * 12/1990 Eberhardt et al. ..... 169/54
5,062,487 A * 11/1991 Siria et al. ..... 169/70
5,833,005 A * 11/1998 Woolcock ..... 169/5
5,845,714 A * 12/1998 Sundholm ..... 169/9
6,763,894 B2 * 7/2004 Schoenrock et al. ..... 169/85

FOREIGN PATENT DOCUMENTS

DE 198 25 420 12/1999
GB 2 246 294 1/1992

* cited by examiner

*Primary Examiner*—Steven J. Ganey
(74) *Attorney, Agent, or Firm*—Young & Thompson

(57) ABSTRACT

An installation includes spray nozzles (1) connected to a pressurized extinguishing liquid supply line (3). Fire detecting elements are connected to elements controlling the supply of the nozzles. The installation comprises a compressed gas container (6) connected by a pipe (5) to a tank (4) containing the liquid and which itself is connected to the supply line (3). The conduit (5) is normally closed by a valve (7) with controlled opening so as to enable compressed gas contained in the container to penetrate into the tank to evacuate the liquid towards the supply line of the nozzles. The nozzles are associated with respective electrically driven fans (9) arranged in series so that an electrically driven fan located downstream of an upstream electrically driven fan sucks in the larger volume between the downstream and upstream electrically driven fans.

15 Claims, 2 Drawing Sheets

STATIONARY AUTOMATIC FIRE-EXTINGUISHING INSTALLATION

The invention relates to a stationary automatic fire extinguishing installation.

There have been known for 120 years installations for automatic fire extinguishing with sprayers commonly called sprinklers. In its simplest form, the sprinkler comprises a deflector and a closure device to normally close a water or foam supply line which is located continuously under pressure. This closure device is provided with a fusible alloy which during increase in temperature is adapted to melt to unblock the supply line so as to direct the liquid toward the deflector for distribution of the poured liquid.

These installations have been improved, especially as to the detection of the beginning of a fire which can be carried out with a detector system connected to a control unit for sprinklers as a function of the detection of fire.

Even if these installations generally are satisfactory, they have nevertheless a certain number of more or less serious drawbacks.

Thus, the sprinkler installations often give incomplete protection because in many localities, only certain regions are provided with sprinklers and when the fire arises in an unprotected region, or propagates to one, the fire cannot be extinguished.

In automatic sprinklers with fusible material, another drawback resides in the fact that once their fusible material has melted, the sprinklers cannot be again assembled and reused. New sprinklers of the same size, type and class of heat resistance must be installed, which gives rise to considerable costs as a result of each fire.

Another drawback of these sprinkler installations resides in the fact that these latter are very consumptive of water and have a destructive effect for example on food products or fragile materials such as stocks of paper or packaging cardboard. Once started, the sprinklers continue to distribute water until manual closing of the water supply. Moreover, there is always the risk that the water supply will be cut off prematurely in the course of a fire, but also that the installation will not be restored to operating condition following a fire.

These installations must moreover be inspected regularly to verify the absence of damage, of corrosion, of water leaks, etc. They must also be regularly tested. In the case of loss of water supply, they are of course out of operation. To avoid this problem, it is necessary also to install an electrical surveillance apparatus for the water supply.

The invention has for its object to overcome the drawbacks mentioned above. To this end, it proposes an installation for automatic fire extinguishing, adapted to wet all the volume of a locality, which reduces the flammability of all the objects located therein. Thanks to the invention, there is furthermore obtained a laying of the dust, the loaders and the fumes of the fire, which gives better visibility and less intoxication to facilitate entry of the firemen into action.

Thanks to the invention, a very small quantity of water is used and damage to sensitive products by the water is avoided.

The installation according to the invention is moreover adapted to create an infrared barrier so as to limit the propagation of the fire by infrared radiation.

The object of the invention is an installation for automatic extinction of fire, comprising a plurality of sprays distributed about a locality to be protected against fire, said sprays being connected to a supply line under pressure of a liquid adapted to extinguish a fire, fire detection means connected to automatic control means for the supply of the sprays by said supply line after detection of a fire by said detection means, and a compressed gas container connected by a conduit to a tank containing said liquid and which in its turn is connected to said supply line, said conduit being normally closed by closure means adapted to be controlled to open by said automatic control means so as to permit said compressed gas contained in said receptacle to enter said tank to expel said liquid toward said supply line of the diffusers, characterized in that said diffusers are spray nozzles for said liquid associated with respective motor driven fans disposed one after the other such that one motor driven fan located downstream of an upstream motor driven fan sucks in the greatest part of the volume between said upstream and downstream motor driven fans, as well as a part of the volume with sprayed liquid blown by said upstream motor driven fan.

According to other characteristics of the invention:

- each of said fans is driven by an electric motor;
- the electric motor is sealed, and a supplemental diffuser is disposed adjacent the motor to cool it;
- the electrical supply lines of the respective motors of the fans extend in said liquid supply line;
- each of said fans is driven by a hydraulic motor in its turn driven by said liquid;
- said tank is disposed above the level of the diffusers, and secondary closure means is inserted in the supply line;
- said secondary closure means is a valve also controlled by said supply control means;
- said automatic control means control the opening of said secondary closure means immediately before controlling the opening of said closure means in said conduit between said compressed gas receptacle and said liquid tank;
- at least two diffusers are gathered about each fan so as to constitute an assembly;
- the liquid is water to which surface active agents have been added.

Other characteristics and advantages of the invention will become apparent from a reading of the description, by way of example, of several embodiments of the installation according to the invention, with reference to the accompanying drawings, in which:

FIG. 1 is a diagram of the principle of a first embodiment of the installation according to the invention. The installation comprises several diffusers 1 constituted by spray nozzles adapted to produce very fine droplets.

Figure 1:
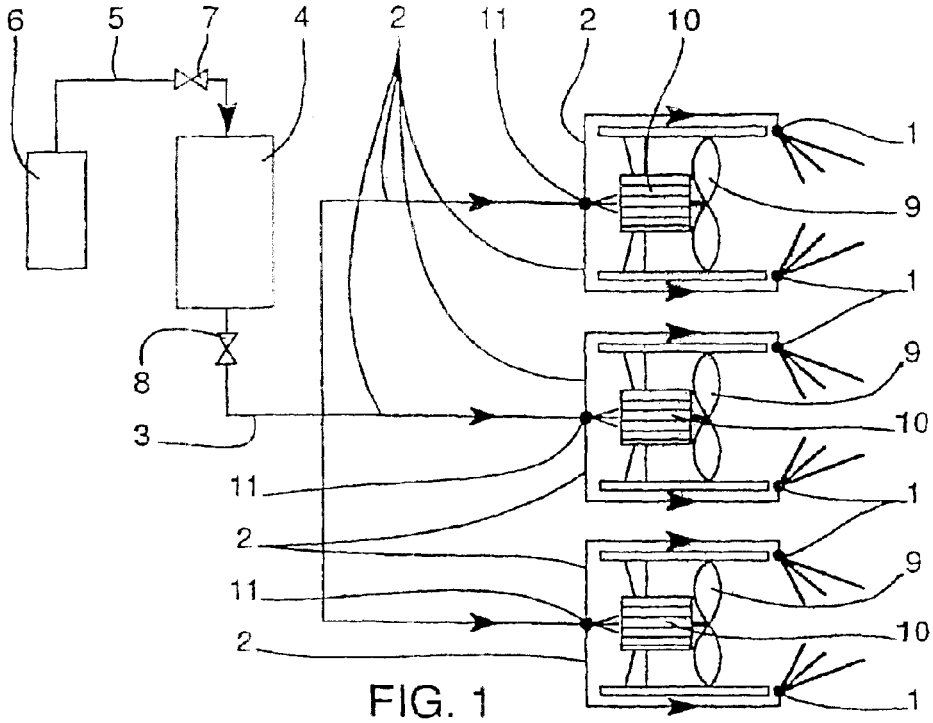
FIG. 1 shows schematically a first embodiment of the invention.

Each diffuser is connected by means of a conduit 2 to a supply line 3 under pressure of a fire extinguishing liquid. This liquid is preferably constituted by water with the addition of surface active agents.

The invention also comprises fire detection means (not shown) comprising conventionally temperature detectors, flame detectors, smoke detectors etc. These detection means are connected to automatic control electrical means (not shown) for supplying the nozzles 1 as a function of detection, this supply taking place from the supply line 3 and the conduits 2.

These detection and automatic control means are completely known per se and as they do not relate directly to the invention, they will not be described further here.

The liquid is permanently stored in a tank 4. A very small quantity of water is necessary, of the order of 1 $l/m^3$ of locality, namely 1 mm of water/$m^2$ and by meter of height of the locality to be protected.

The tank 4 is connected by a conduit 5 to a compressed gas receptacle 6. Closure means in the form of a quick opening isolation valve 7 is inserted in the conduit 5. This valve is normally closed to prevent the gas confined in the receptacle 6 from entering the tank 4.

Opening the valve 7 is controlled directly by the control means connected to the fire detection means to receive from it an actuation signal.

In the case in which the tank 4 is located at a higher level than that of the diffusers 1, for example in roofing, a secondary closure means in the form of a quick opening isolation valve 8 is inserted in the supply line 3 so as to prevent the liquid from flowing toward the diffusers by simple gravity.

In this case, opening the secondary closure means 8 is controlled immediately before the opening of the closure means 7 is effected. Because the pressure exerted by the gas is in this case added to the pressure of gravity of liquid, the result is that the pressure in the supply line 3 is further increased.

According to a modification not shown, the closure means is constituted by a double siphon.

To improve and accelerate diffusion throughout all the volume of the locality to be protected against fire, each diffuser 1 is associated with a liquid propulsion means in the form of a motor driven fan 9.

The fans 9 are disposed adjacent the respective diffusers 1 so as to blow directly on the sprayed liquid which leaves the latter at the beginning of a detected fire.

The figures show the diffusers 1 disposed laterally relative to the axis of the fan, but they can of course be disposed in a manner to blow directly along the axis.

In an embodiment shown in FIG. 1, each fan 9 is driven by an electric motor 10. To cool the motor 10, the latter is preferably sealed and associated with a secondary diffuser 11 disposed in the conduit 2 of the diffuser. The motor 9 is connected to the control means which also controls the starting of the motor upon detection of a fire by the detection means.

Preferably, the electric supply lines of the motors 10 extend within the liquid supply line 3 and within the conduit 2 such that they will be protected against melting in case of fire.

Figure 2:
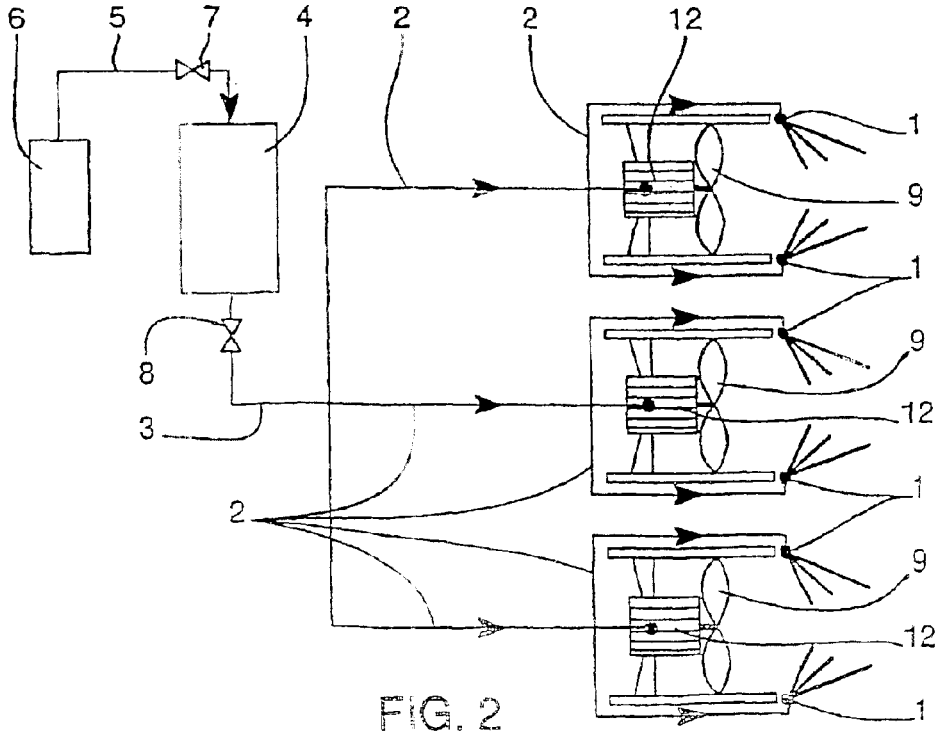
FIG. 2 shows schematically a second embodiment of the invention.

To obtain a distribution and rapid and effective dispensing of the liquid upon detection of a fire, two diffusers 1 are in the illustrated example in FIGS. 1 and 2 gathered about each fan 9 so as to constitute an assembly. The assemblies thus constituted are disposed regularly and in sufficient number about the locality to be protected. They are preferably disposed in the ceiling of the locality, but also in the walls so that the sprayed liquid rapidly saturates the atmosphere within all the volume of the locality.

Figure 3:
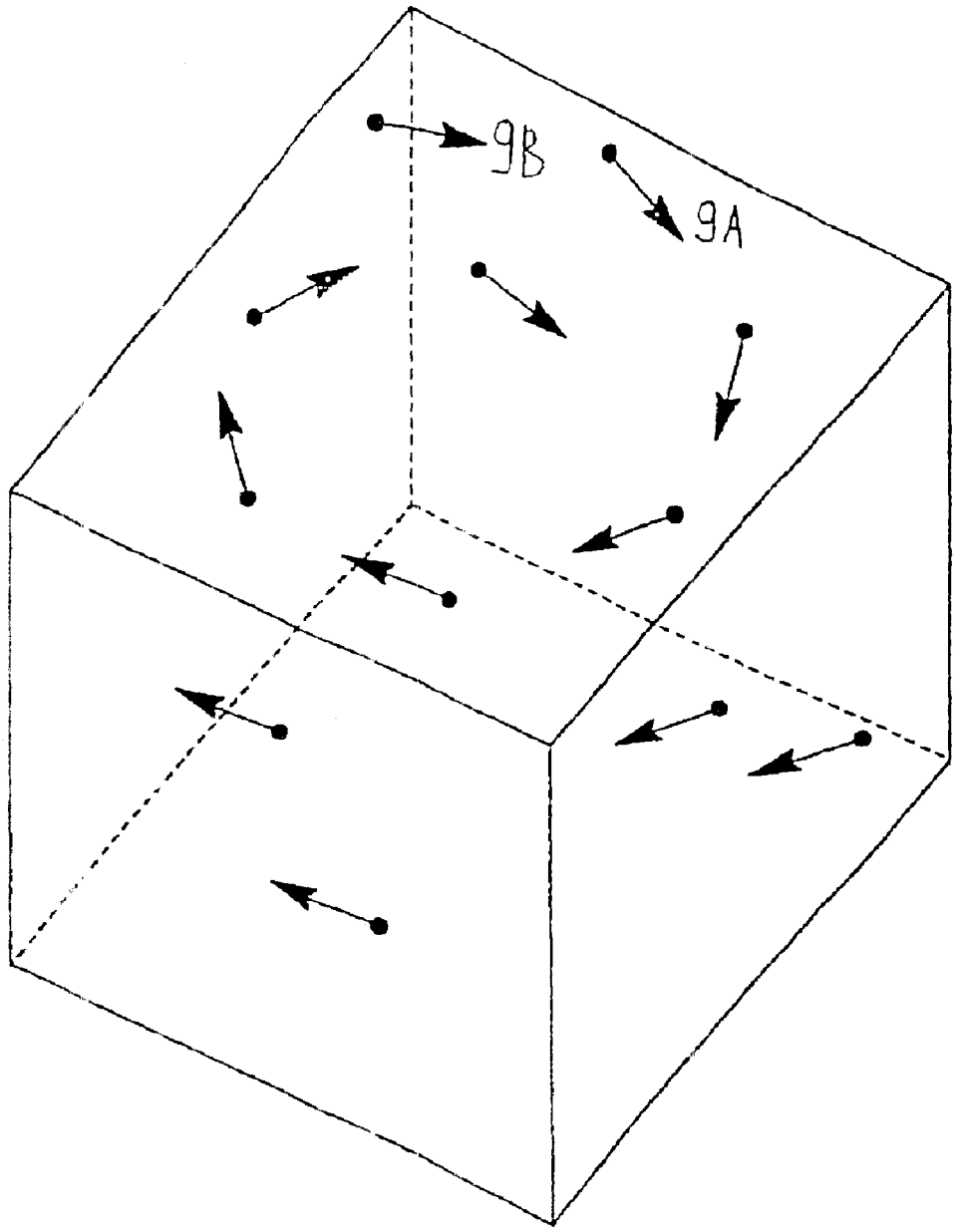
FIG. 3 is a schematic perspective view showing an example of the arrangement of the diffusers of the installation according to the invention.

An arrangement of the assemblies is schematically shown in FIG. 3. The motor driven fans 9, of which each is thus associated with at least one diffuser 1, are according to the invention disposed one after the other such that one motor driven fan 9A located downstream of an upstream motor driven fan 9B sucks most of the volume between these upstream and downstream motor driven fans, as well as a portion of the volume of sprayed liquid blown by said upstream motor driven fan.

More precisely, the motor driven fans are disposed such that once started, they simultaneously suck in all the volume of air that is not saturated, located between them and the respective upstream fan, and they also begin simultaneously to recycle the air with sprayed liquid from the upstream fans, which permits saturating homogeneously all the volume of air of the locality with sprayed droplets.

It is to be noted that the assemblies are moreover preferably disposed so as to produce a whirlpool movement when the diffusers are operated.

The installation described with reference to FIG. 1 operates in the following manner.

When a detector of the detection means detects the beginning of a fire in the locality, it sends an actuating signal to the control means which in their turn send an opening signal to the valve 7 so as to permit the compressed gas contained in the receptacle 6 to enter the conduit 5 within the tank 4 to expel liquid from it toward the supply line 3.

The liquid propelled by the gas passes through the conduits 2 to supply the respective diffusers 1. In the embodiment shown in FIG. 1, the cooling diffuser 2 of the motor 10 is supplied at the same time.

The liquid is sprayed from diffusers 1 and propelled by the fans 9 which receive a start signal at the same time as the valve 7, or, as the case may be, the valve 8.

Thanks to the arrangement of the motor driven fans 9 described above, the sprayed liquid is uniformly and rapidly distributed over the locality which is soon saturated in moisture to prevent the fire from propagating and which finally extinguishes it.

A second embodiment of the installation according to the invention will now be described with reference to FIG. 2. The same elements as those already described with reference to FIG. 1 have the same reference numerals.

The essential difference relative to the first embodiment is as to the motor driven fan and for this reason, the common elements will not be described in detail.

The fan 9 according to this embodiment is driven in rotation by a hydraulic motor 12 connected to the supply line 3 of the liquid by means of the conduit 2 through which the diffusers 1 are supplied.

As a modification, the hydraulic motors are driven by oil, and in still another modification, they are driven by compressed air.

The operation of the installation is the same as for the embodiment of FIG. 1, only simpler because the hydraulic motors of the fans are automatically driven as soon as the diffusers 1 are supplied.

The installation according to the invention has several supplemental advantages relative to previously known installations, among others:

- Decrease of the temperature by partial evaporation of the droplets which involves pumping by the latent heat of evaporation;
- Constitution of an infrared barrier created by the water mist;
- Suppression of the effect of flames;
- Wetting of all the volume, which reduces the flammability of all of the objects above and below the diffusers;
- Laying the dust, odors and fumes from the fire;
- Very small quantity of water required, which permits the storage of water at the top of the building or locality, without excessively increasing the weight on the structures;
- The possibility of protecting or stopping the burning of flammable foodstuffs such as dry cocoa beans or fragile material such as stocks of paper or cardboard packaging without destroying them, contrary to the case with sprinklers;

Moreover, the installation according to the invention permits testing without any risk of damaging the objects located in the localities to be protected. It suffices to send a smaller quantity into the distributors so as to verify the operation of the installation.

Of course, the invention is not limited to the examples described above. The installation according to the invention can moreover be combined with other more conventional installations, among others with sprinklers, which can enter into action if it is detected that the fir continues to propagate despite the operation of the installation according to the invention. There can thus be obtained an automatic fire extinguishing process with several stages.

What is claimed is:

1. Automatic fire extinguishing installation comprising a plurality of diffusers (1) distributed about a locality to be protected from fire, said diffusers (1) being connected to a line (3) for the supply under pressure of a liquid adapted to extinguish a fire, fire detection means connected to automatic control means for the supply of the diffusers (1) by said supply line (3) following the detection of a fire by said detection means, and a compressed gas receptacle (6) connected by a conduit (5) to a tank (4) containing said liquid and which in its turn is connected to said supply line (3), said conduit (5) being normally closed by closure means (7) adapted to be controlled to open by said automatic control means so as to permit said compressed gas contained in said receptacle (6) to enter said tank (4) to expel said liquid toward said supply line (3) of the diffusers (1), characterized in that said diffusers are spray nozzles for said liquid associated with respective motor driven fans (9) disposed one after the other such that a motor driven fan (9A) located downstream of an upstream motor driven fan (9B) sucks in the greatest part of the volume between said upstream and downstream motor driven fans (9A, 9B), as well as a portion of the volume with sprayed liquid blown by said upstream motor driven fan.

2. Installation according to claim 1, characterized in that each of said fans (9) is driven by an electric motor (10).

3. Installation according to claim 2, characterized in that the electric motor (10) is sealed, and in that a supplemental diffuser (11) is disposed adjacent the motor to cool it.

4. Installation according to claim 1, characterized in that the electric supply lines of the respective motors (10) of the fans extend within said liquid supply line (2, 3).

5. Installation according to claim 1, characterized in that each of said fans (9) is driven by a hydraulic motor (12).

6. Installation according to claim 1, characterized in that said tank (4) is disposed above the level of the diffusers (1), and in that secondary closure means (8) is inserted in the supply line (3).

7. Installation according to claim 6, characterized in that said secondary closure means (8) is a valve also controlled by said supply control means.

8. Installation according to claim 6, characterized in that said automatic control means controls the opening of said secondary closure means (8) immediately before controlling the opening of said closure means (7) in said conduit between said compressed gas receptacle (6) and said liquid tank (4).

9. Installation according to claim 1, characterized in that at least two diffusers (1) are grouped about each fan (9) so as to constitute an assembly.

10. Installation according to claim 1, characterized in that the liquid is water with added surface active agents.

11. Installation according to claim 2, characterized in that said tank (4) is disposed above the level of the diffusers (1), and in that a secondary closure means (8) is inserted in the supply line (3).

12. Installation according to claim 3, characterized in that said tank (4) is disposed above the level of the diffusers (1), and in that a secondary closure means (8) is inserted in the supply line (3).

13. Installation according to claim 4, characterized in that said tank (4) is disposed above the level of the diffusers (1), and in that a secondary closure means (8) is inserted in the supply line (3).

14. Installation according to claim 5, characterized in that said tank (4) is disposed above the level of the diffusers (1), and in that a secondary closure means (8) is inserted in the supply line (3).

15. Installation according to claim 7, characterized in that said automatic control means controls the opening of said secondary closure means (8) immediately before controlling the opening of said closure means (7) in said conduit between said compressed gas receptacle (6) and said liquid tank (4).

* * * * *